US011511151B2

(12) United States Patent
Brooke

(10) Patent No.: US 11,511,151 B2
(45) Date of Patent: Nov. 29, 2022

(54) OPPOSITE RECIPROCAL MOVEMENT REHABILITATION

(71) Applicant: Marvin Brooke, Mercer Island, WA (US)

(72) Inventor: Marvin Brooke, Mercer Island, WA (US)

( * ) Notice: Subject to any disclaimer, the term of this patent is extended or adjusted under 35 U.S.C. 154(b) by 210 days.

(21) Appl. No.: 17/084,489

(22) Filed: Oct. 29, 2020

(65) Prior Publication Data

US 2021/0128973 A1 May 6, 2021

Related U.S. Application Data

(60) Provisional application No. 62/928,774, filed on Oct. 31, 2019.

(51) Int. Cl.

| | |
|---|---|
| ***A63B 23/16*** | (2006.01) |
| ***A63B 21/04*** | (2006.01) |
| ***A63B 21/00*** | (2006.01) |

(52) U.S. Cl.

CPC .... *A63B 21/4045* (2015.10); *A63B 21/00178* (2013.01); *A63B 21/4019* (2015.10); *A63B 21/4049* (2015.10); *A63B 23/16* (2013.01); *A63B 21/00185* (2013.01); *A63B 21/0421* (2013.01)

(58) Field of Classification Search

CPC ..... A63B 21/00178; A63B 21/00185; A63B 21/4019; A63B 21/4045; A63B 21/4049; A63B 21/026; A63B 21/028; A63B 21/0421; A63B 21/045; A63B 21/0455; A63B 21/4021; A63B 21/4023; A63B 21/4025; A63B 21/4033; A63B 21/4034; A63B 21/4047; A63B 23/16; A63B 23/14

See application file for complete search history.

(56) References Cited

U.S. PATENT DOCUMENTS

| | | | | |
|---|---|---|---|---|
| 8,777,821 | B2 * | 7/2014 | Lando | A63B 23/1245 482/121 |
| 9,387,360 | B2 * | 7/2016 | Niederman | A63B 21/00069 |
| 9,675,837 | B2 * | 6/2017 | Smith | A63B 21/02 |
| 10,220,237 | B2 * | 3/2019 | Bentley | A63B 21/00043 |
| D948,645 | S * | 4/2022 | Chin | A63B 21/4035 D21/693 |
| 2005/0233877 | A1 * | 10/2005 | Lin | A63B 21/026 482/121 |
| 2016/0074689 | A1 * | 3/2016 | Anderson | A63B 21/00069 482/127 |
| 2022/0184444 | A1 * | 6/2022 | An | A63B 21/4035 |

* cited by examiner

*Primary Examiner* — Megan Anderson
(74) *Attorney, Agent, or Firm* — Miller IP Law

(57) ABSTRACT

Some embodiments include an outer tube, a pivot structure, an inner tube, a rotational element, and a central rod. The pivot structure perpendicularly intersects the outer tube at a midpoint of the outer tube. The inner tube is coaxially within the outer tube. A first portion of the inner tube is within the outer tube on one side of the pivot structure. A second portion of the inner tube is within the outer tube on another side of the pivot structure. The rotational element couples to the pivot structure, rotates about an axis of the pivot structure, and interfaces with the first and second portions of the inner tube to cause rotation of one portion of the inner tube in a first rotational direction to counter-rotate the other portion of the inner tube in a second rotational direction. The central rod is within the inner tube and translates axially.

20 Claims, 7 Drawing Sheets

OPPOSITE RECIPROCAL MOVEMENT REHABILITATION

CROSS-REFERENCE TO RELATED APPLICATIONS

The present application claims priority to U.S. Provisional Patent Application No. 62/928,774 entitled "OPPOSITE RECIPROCAL MOVEMENT REHABILITATION," filed on 31, Oct. 2019. The entire contents of the above-listed application are hereby incorporated by reference for all purposes.

BACKGROUND

Therapy after stroke, injury, surgery, for pain reduction, or so forth, frequently focuses on the restoration of dexterity in an affected hand, arm, or shoulder. Permanent loss of dexterity due to severity of the cause, ineffectiveness of the therapy, or difficulty in completing the therapy properly can result in a reduction in capability, personal independence, and quality of life. Therapies which involve restraint of an unaffected limb can promote neural plasticity and improve a situation but may also be difficult, frustrating, and have a lower effectiveness.

BRIEF DESCRIPTION OF THE DRAWINGS

The present description will be understood more fully when viewed in conjunction with the accompanying drawings of various examples of opposite reciprocal movement rehabilitation. The description is not meant to limit the opposite reciprocal movement rehabilitation to the specific examples. Rather, the specific examples depicted and described are provided for explanation and understanding of opposite reciprocal movement rehabilitation. Throughout the description, the drawings may be referred to as drawings, figures, and/or FIGs.

DETAILED DESCRIPTION

An opposite reciprocal movement rehabilitation as disclosed herein will become better understood through a review of the following detailed description in conjunction with the figures. The detailed description and figures provide merely examples of the various embodiments of opposite reciprocal movement rehabilitation. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

Conventional rehabilitation devices may include restraint systems which rely on the immobilization of an unaffected limb to force the use of the affected limb to stimulate neural plasticity to establish neural pathways to improve control and dexterity in the affected limb.

Implementations of opposite reciprocal movement rehabilitation may address some or all of the problems described above. A rehabilitation device may provide the ability to use opposite reciprocal movement of the affected limb by coupling the affected limb to the unaffected limb. Using the unaffected limb to move the affected limb in an opposite reciprocal movement pattern provided improved neural plasticity over conventional approaches resulting in greater recovery from stroke, injury, surgery, and so forth.

Figure 1:
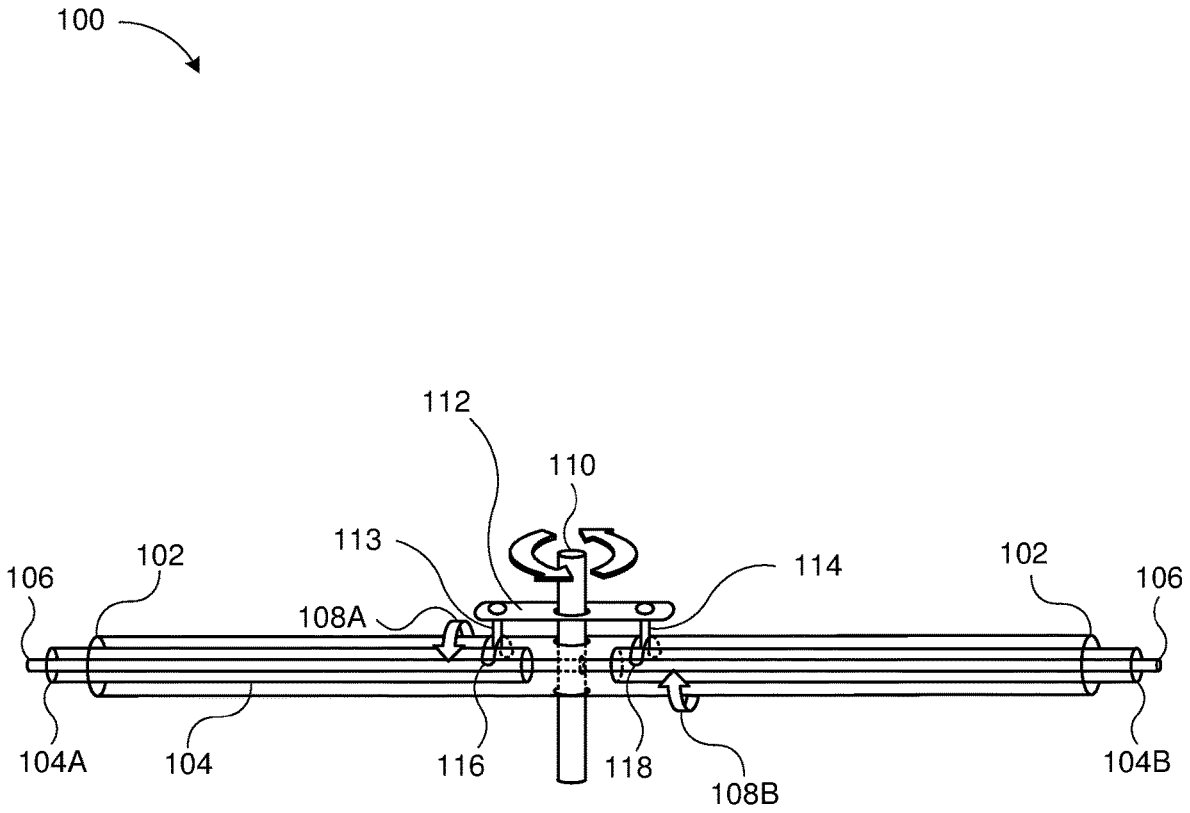
FIG. 1 illustrates a perspective view of a rehabilitation device in a first position, according to an embodiment.

FIG. 1 illustrates a perspective view of a rehabilitation device 100 in a first position, according to an embodiment. The rehabilitation device 100 utilized counter-rotation to provide opposite reciprocal movement of limbs to improve dexterity and control through stimulation of neural plasticity. Reciprocal and repetitive functional movements of the affected hand, which are powered by and requiring the unaffected hand reciprocal opposite movements, may result in activation and neural plastic recovery of many alternative neurologic, visual, motor, reflex and functional pathways.

In some embodiments, the rehabilitation device 100 includes an outer tube 102, an inner tube 104, and a central rod 106. In some embodiments, the central rod 106 may be disposed within the inner tube 104, In some embodiments, the inner tube 104 may be disposed interior to the outer tube 102. The inner tube 104 may be divided into a first portion 104A and a second portion 104B. In some embodiments, the first portion 104A of the inner tube 104 may rotate within the outer tube 102 in a first rotational direction 108A and the second portion 104B of the inner tube 104 may rotate within the outer tube 102 in a second rotational direction 108B. in some embodiments, the first rotational direction 108A and the second rotational direction 108B are opposite one another.

In some embodiments, the central rod 106 extends through a pivot structure 110. In some embodiments, the pivot structure 110 may be an elongated element oriented perpendicular to the central rod 106, the inner tube 104, and the outer tube 102. In some embodiments, the pivot structure 110 runs through the outer tube 104 to be between the first portion 104A of the inner tube 104 and the second portion 104B of the inner tube 104. In some embodiments, the pivot structure 110 is coupled to a rotational element 112. The rotational element 112 may be disposed so as to rotate about the pivot structure 110 in a rotational direction in response to a force applied at the rotational element in a direction The rotational element 112 is configured to link the first portion 104A of the inner tube 104 to the second portion 104B of the inner tube 104 such that rotation of one of the first portion 104A of the inner tube 104 or the second portion 104B of the inner tube 104 causes rotation of the other of the first portion 104A of the inner tube 104 or the second portion 104B of the inner tube 104. In some embodiments, the rotational element 112 may have an elongated geometry to extend from the first portion 104A of the inner tube 104 to the second portion 104B of the inner tube 104. The rotational element 112 may receive a force input from a rotation of one of the first portion 104A of the inner tube 104 to the second portion 104B of the inner tube 104 and apply a rotational force in the opposite direction at the other of the first portion 104A of the inner tube 104 to the second portion 104B of the inner tube 104. For example, a rotation of the first portion 104A of the inner tube 104 may apply a force input on the rotational element 112 in the first rotational direction 108A which pivots the rotational element 112 about the pivot structure 110 and applies a force to the second portion 104B of the inner tube 104 in the second rotational direction 108B.

In some embodiments, the rotational element 112 is flexible to accommodate deflection of the rotational element 112 from end to end to move corresponding ends of the rotational element 112 around with rotation of the first portion 104A of the inner tube 104 and with rotation of the second portion 104B of the inner tube 104. The rotational element 112 may be coupled to a first post 113 extending from the first portion 104A of the inner tube 104 and a second post 114 extending from the second portion 104B of the inner tube 104. In some embodiments, the first post 113 is coupled to the first portion 104A of the inner tube 104 at an end of the first portion 104A that is proximate the pivot structure 110 and the second post 114 is coupled to the second portion 104B of the inner tube 104 at an end of the second portion 104B that is proximate the pivot structure 110.

In some embodiments, the first post 113 may extend perpendicularly outward from the first portion 104A of the inner tube 104 and the second post 114 may extend perpendicularly outward from the second portion 104B of the inner tube 104. In some embodiments, the first post 113 and the second post 114 are coupled to the rotational element 112 in a manner that allows for rotation of the first post 113 and the second post 114 relative to the rotational element 112. For example, at least one of the first post 113, the second post 114, or the rotational element 112 includes a head, latch, ball, socket, hook, or so forth, to attach the first post 113 and the second post 114 to the rotational element 112.

In some embodiments, the first post 113 extends, from the first portion 104A of the inner tube 104 to the rotational element 112, through a first slot 116 formed in the outer tube 102 and the second post 114 extends, from the second portion 104B of the inner tube 104, through a second slot 118 formed in the outer tube 102. In some embodiments, the first slot 116 and the second slot 118 may be parallel. In other embodiments, the first slot 116 and the second slot 118 are oriented at an angle relative to one another. In some embodiments, the first slot 116 and the second slot 118 facilitate movement of the first post 113 and the second post 114 relative to the outer tube 102 in response to rotation of the first portion 104A and the second portion 104B of the inner tube 104.

In some embodiments, the central rod 106 is configured to translate along its axis through the pivot structure 110. In some embodiments, the central rod 106 is free to rotate. In some embodiments, the central rod 106 is flexible. In other embodiments, the central rod 106 is rigid or semi-rigid. In some embodiments, the central rod 106 includes a stopper or other structure to limit a translation or rotation of the central rod 106 relative to the inner tube 104, the outer tube 102, the pivot structure 110, or so forth.

Figure 2:
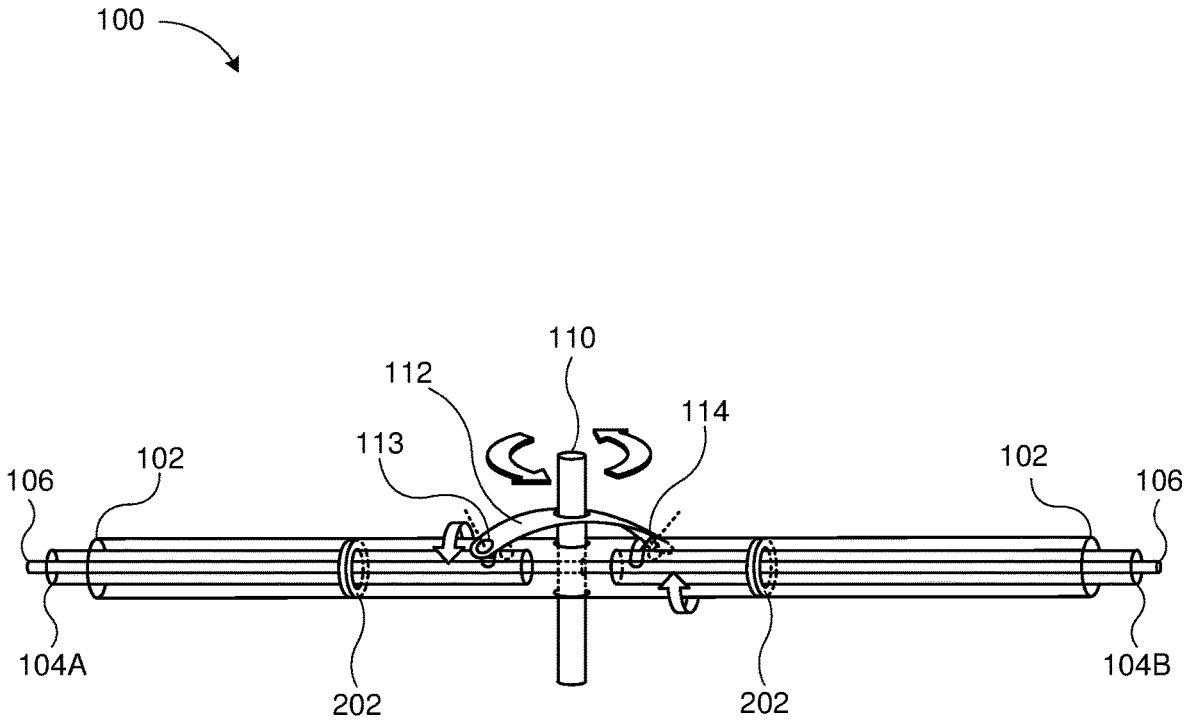
FIG. 2 illustrates the rehabilitation device of FIG. 1 in a second position, according to an embodiment.

FIG. 2 illustrates the rehabilitation device 100 of FIG. 1 in a second position, according to an embodiment. The rehabilitation device 100 may provide a relatively low-cost and accessible system for reestablishing neural pathways for improved dexterity and restoring motor control.

In some embodiments, the rotational element 112 may be configured to deflect in response to rotation of the first portion 104A and/or the second portion 104B of the inner tube 104. In some embodiments, the rotational element 112 may translate along an axis of the pivot structure 110, the first post 113, or the second post 114. In some embodiments, the rotational element 112 is slotted at one or more of the pivot structure 110, the first post 113, or the second post 114 to allow for relative movement of the rotational element 112 perpendicular to an axis of the corresponding one or more of the pivot structure 110, the first post 113, or the second post 114.

In some embodiments, the rehabilitation device 100 may include an alignment structure 202. The alignment structure 202 may be positioned between the outer tube 102 and the inner tube 104, between the inner tube 104 and the central rod 106, between the pivot structure and the outer tube 102, or so forth. In some embodiments, multiple alignment structures 202 are positioned at different locations within the rehabilitation device 100. In some embodiments, the alignments structures 202 may include a washer, o-ring, bearing, gasket, or so forth. In some embodiments, the alignment structure 202 may provide a physical stop. In other embodiments, the alignment structure 202 may maintain a spacing between components of the rehabilitation device 100. For example, the alignment structure 202 may be a ring positioned around a portion of the inner tube 104 to maintain a spacing between the inner tube 104 and the outer tube 102 in which an inner diameter of the alignment structure 202 is approximately equivalent to an outer diameter of the inner tube 104 and an outer diameter of the alignments structure 202 is approximately equivalent to an inner diameter of the outer tube 102.

Figure 3:
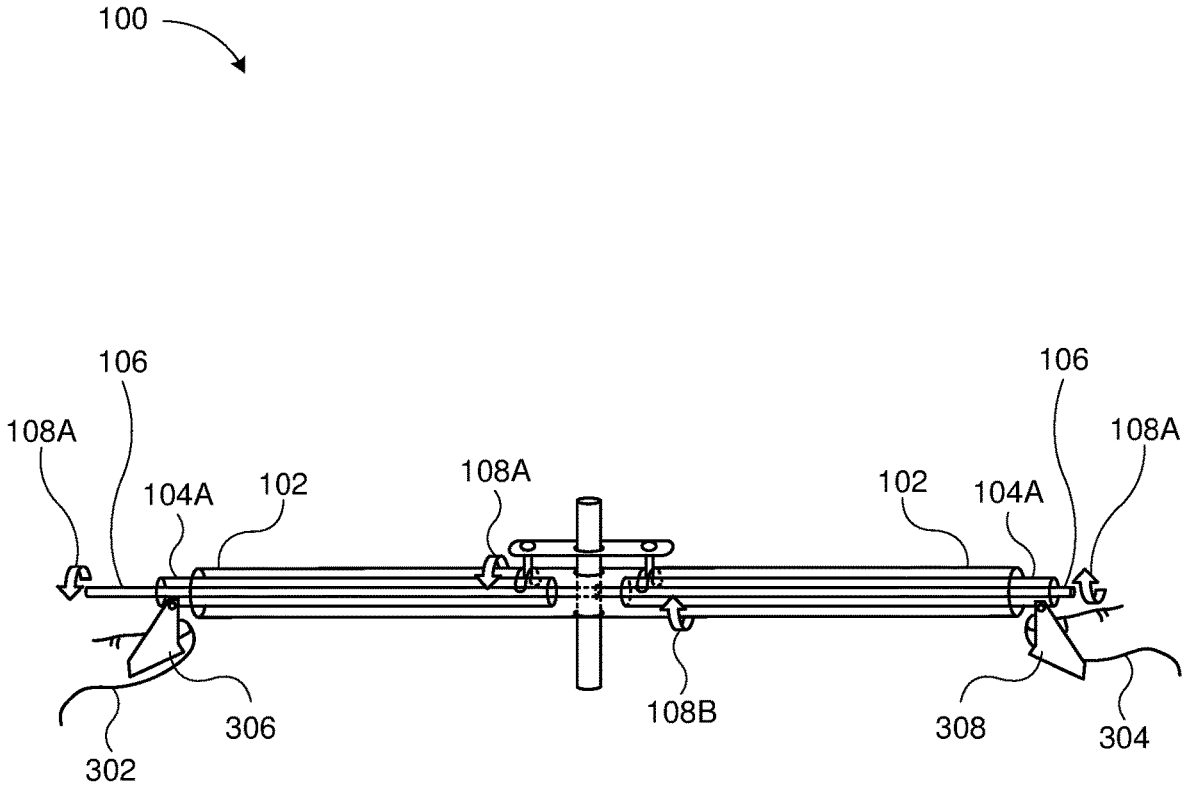
FIG. 3 illustrates the rehabilitation device of FIG. 1 with fingers of a user, according to an embodiment.

FIG. 3 illustrates the rehabilitation device of FIG. 1 with fingers of a user, according to an embodiment. The rehabilitation device 100 may facilitate an intuitive therapy process for stimulating neural plasticity in stroke recovery, surgical recovery, pain therapy, brain injury recovery, physical injury recovery, mental exercise, or so forth.

In some embodiments, a user may engage with the rehabilitation device 100 by attaching the rehabilitation device 100 to digits of the left and right hands. For example, the user may attach a left thumb 302 to the rehabilitation device 100 to be at a distal end of the first portion 104A of the inner tube 104 with a right thumb 304 attached to the rehabilitation device 100 to be at a distal end of the second portion 104B of the inner tube 104.

In some embodiments, the left thumb 302 may be coupled to the first portion 104A of the inner tube 104 via a first coupler 306 and the right thumb 304 may be coupled to the second portion 104B of the inner tube 104 via a second coupler 308. Some embodiments of the couplers 306 and 308 cradle a digit of the user. Other embodiments of the couplers 306 and 308 may attach to an upper surface of the digit, such as a nail of the digit. In some embodiments, the couplers 306 and 308 are adhered to the corresponding thumb 302 and 304. In other embodiments, the couplers 306 and 308 are secured via wrapping, clasping, friction fit, or so forth. In some embodiments, the couplers 306 and 308 may be hingedly connected to the inner tube 104 to allow the couplers 306 and 308 to rotate relative to the inner tube 104 thereby rotating the thumbs 302 and 304 relative to the inner tube 104.

In some embodiments, rotation of the left thumb 302 in the first rotational direction 108A results in a counter-rotation of the right thumb 304 in the second rotational direction 108B. In other words, a rotation of the left thumb 302 results in an opposite rotation of the right thumb 304.

In some embodiments, the left thumb 302 and the right thumb 304 are held below an axis of the central rod 106. In other embodiments, the left thumb 302 and the right thumb 304 may be held at or above an axis of the central rod 106.

In some embodiments, the thumbs 302 and 304 are similarly positioned relative to the rehabilitation device 100. In other embodiments, each of the left thumb 302 and the right thumb 304 may be separately positioned to accommodate a condition, therapy approach, or so forth.

Figure 4:
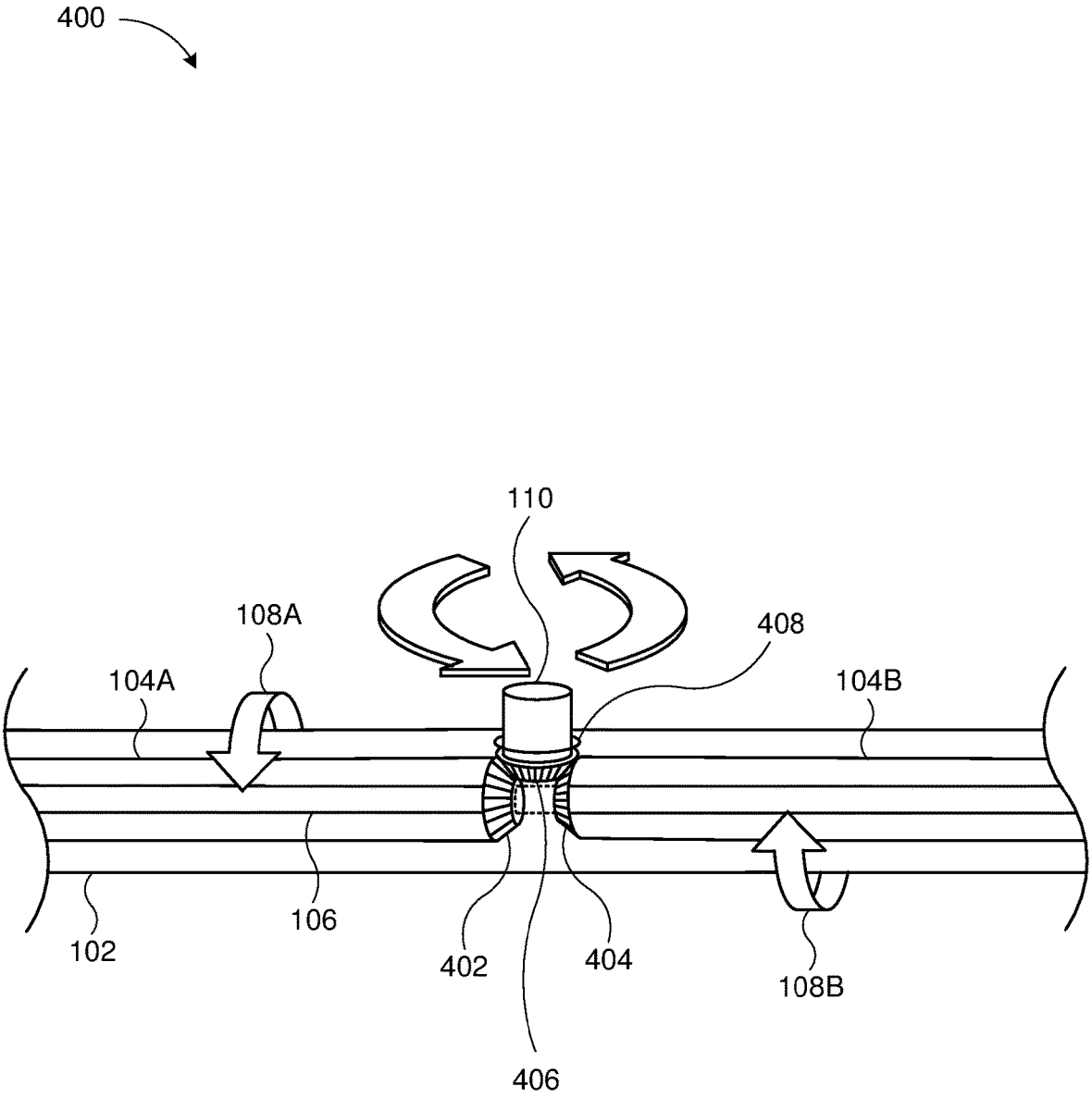
FIG. 4 illustrates a perspective view of a gear interface of the rehabilitation device of FIG. 1, according to an embodiment.

FIG. 4 illustrates a perspective view of a gear interface 400 of the rehabilitation device of FIG. 1, according to an embodiment. In some embodiments, a gear interface 400 may provide reduced size, weight, and complexity. Additionally, the gear interface 400 may provide improved robustness, reduced failure rate, and reduced likelihood of user tampering or error.

In some embodiments, the gear interface 400 may provide a gear-based mechanism in place of a lever-based mechanism illustrated in FIG. 1. In some embodiments, the gear interface 400 includes a first bevel gear 402 disposed at an end of the first portion 104A of the inner tube 104 proximate the pivot structure 110. A second bevel gear 404 may be disposed on an end of the second portion 104B of the inner tube 104 that is proximate the pivot structure 110. In some embodiments, the first bevel gear 402 and the second bevel gear 404 are approximately parallel to one another. In other embodiments, the first bevel gear 402 and the second bevel gear 404 may be oriented at an angle relative to one another.

In some embodiments, each of the first bevel gear 402 and the second bevel gear 404 engage with a pivot bevel gear 406 disposed on the pivot structure 110 to be between the first bevel gear 402 and the second bevel gear 404. In some embodiments, the pivot bevel gear 406 is oriented non-parallel to both the first bevel gear 402 and the second bevel gear 404. In other embodiments, the pivot bevel gear 406 is oriented perpendicular to at least one of the first bevel gear 402 and the second bevel gear 404.

In some embodiments, as either the first bevel gear 402 or the second bevel gear 404 is rotated by rotation of the corresponding portion of the inner tube 104, the pivot bevel gear is rotated and the other of the first bevel gear 402 or the second bevel gear 404 is rotated in an opposite direction.

In some embodiments, the gear interface 400 includes a force structure to apply a force to, at least one of, maintain the first bevel gear 402 in contact with the pivot bevel gear 406 or maintain the second bevel gear 404 in contact with the pivot bevel gear 406. For example, a collar, ring, alignment structure, cage, brace, or so forth may be incorporated to prevent the gears 402-406 from slipping or disengaging relative to one another. In some embodiments, the gears 402-406 may be sized or shaped to provide a ratio of rotation such that rotation of one of the gears 402-406 results in a lesser or greater rotation of another of the gears 402-406. In some embodiments, at least one of gears 402-406 may include a spur gear, a helical gear, a spiral gear, a miter gear, a straight gear, an internal gear, a worm gear, a rack-and-pinion, and so forth.

Figure 5:
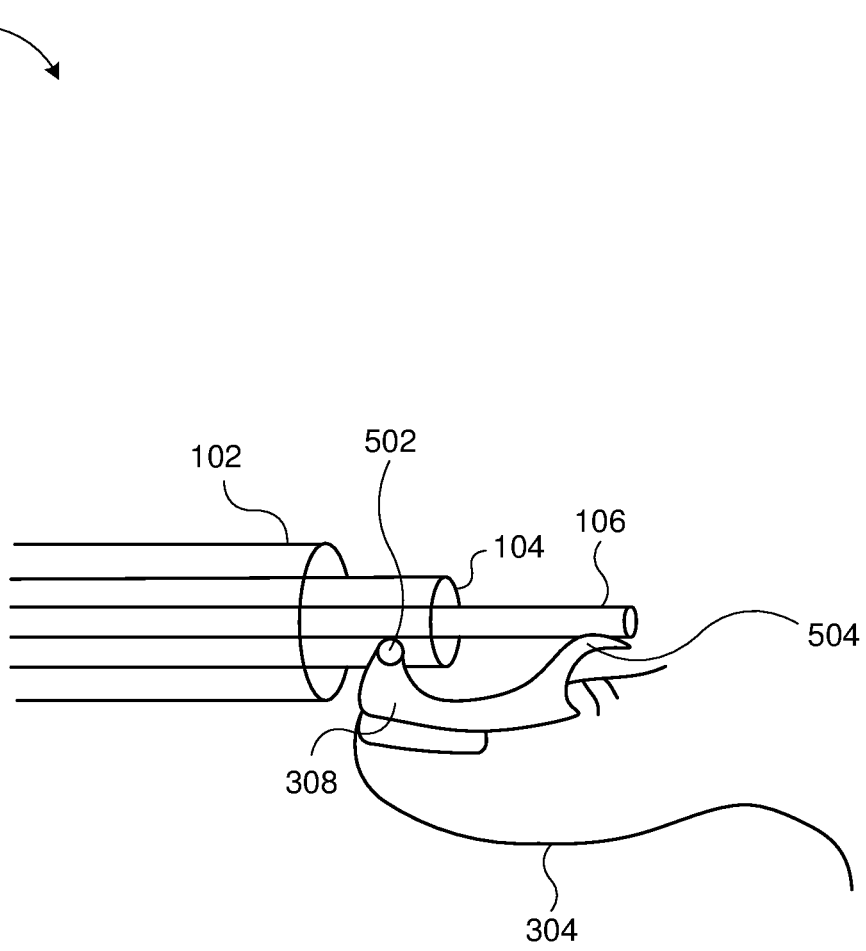
FIG. 5 illustrates an interface end of the rehabilitation device of FIG. 1, according to an embodiment.

FIG. 5 illustrates an interface end 500 of the rehabilitation device 100 of FIG. 1, according to an embodiment. Some embodiments allow for a simple and intuitive connection to a user's hand to provide simple and intuitive movement coordination to stimulate neural plasticity and facilitate the performance of tasks without overly complicating and frustrating the process for the user.

In some embodiments, the user's thumb 304 is coupled to the rehabilitation device 100, at the interface end 500 of the rehabilitation device 100, via the coupler 308. In some embodiments, the coupler 308 is connected to the central rod 106 via a rotatable connection 502. The rotatable connection 502 may be configured to allow the coupler 308, and thus the thumb 304, to pivot, about the rotatable connection 502, relative to the central rod 106. This pivotability of the thumb 304 may allow for flexure-extension ability in the thumb 304 providing more advanced and thorough movement and therapy options.

In some embodiments, the coupler 308 may include a rod connector 504 that interfaces the central rod 106 with the coupler 308. In some embodiments, the rod connector 504 may allow the central rod 106 to apply a force to the coupler 308 to move the thumb 304 in flexure-extension. In some embodiments, rod connector 504 is attached to the central rod 106 to allow the central rod 106 to translate relative to the coupler 308. For example, the central rod 106 may slide along the rod connector 504 or be coupled, at a point on the central rod, to the rod connector 504.

Figure 6:
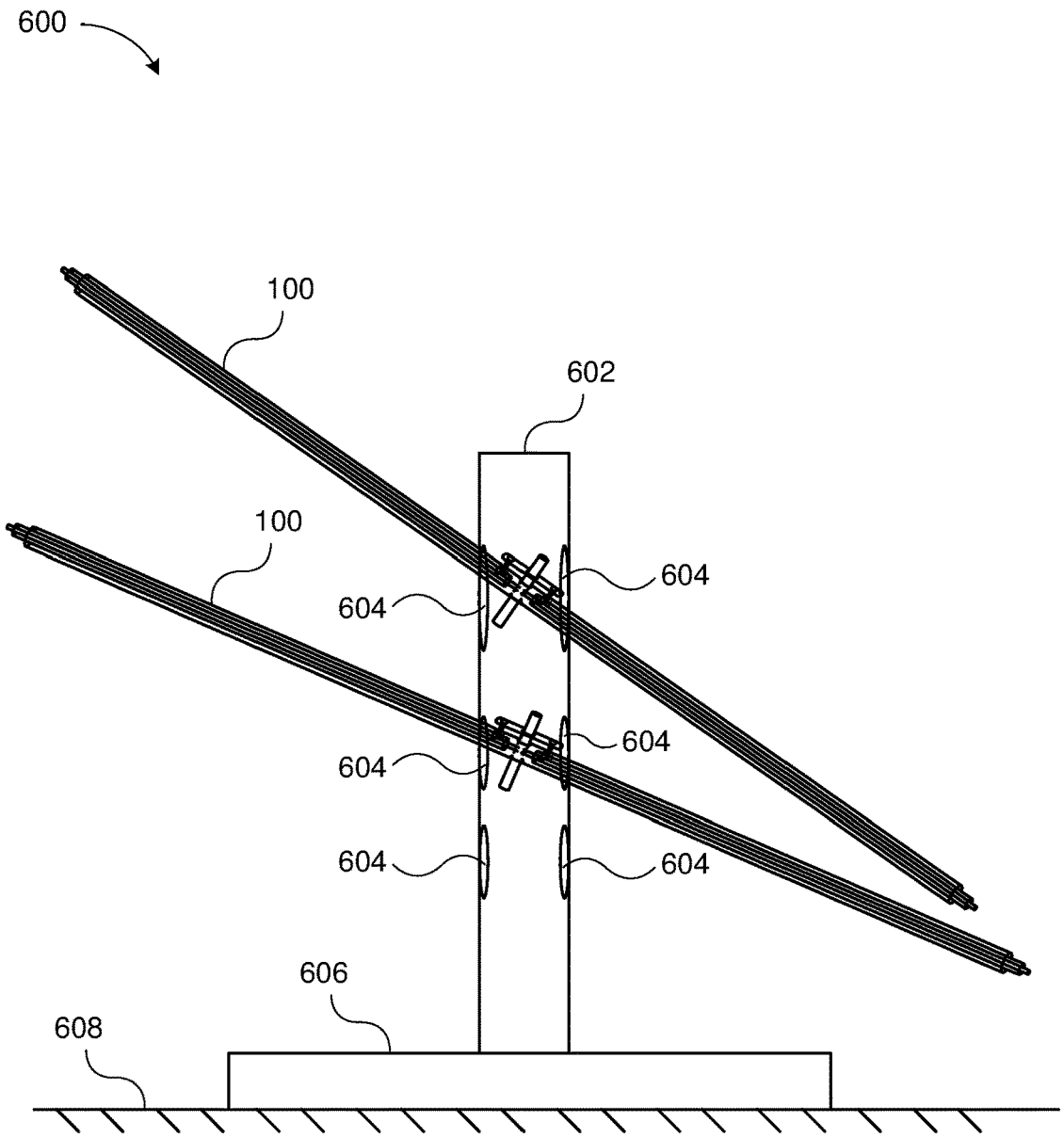
FIG. 6 illustrates an elevation view of a rehabilitation system, according to an embodiment.

FIG. 6 illustrates an elevated view of a rehabilitation system 600, according to an embodiment. In some embodiments, the rehabilitation system 600 allows a user to implement opposite reciprocal motion using an unaffected limb in conjunction with an affected limb to stimulate neural plasticity in the brain to form neural pathways for improvement of dexterity and motor function.

In some embodiments, a rehabilitation device 100 may be arranged in a positioning structure 602. Embodiments of the positioning structure 602 may include openings 604 which may allow the rehabilitation device 100 to be situated in the positioning structure 602. In some embodiments, multiple rehabilitation devices 100 may be situated in the position structure 602 by placing each rehabilitation device 100 in a corresponding opening 604 in the positioning structure 602. In some embodiments, the positioning structure 602 may be hollow allowing space for a component of the rehabilitation device 100 within an interior of the positioning structure 602. In other embodiments, the positioning structure 602 may have portions of the interior that are solid and may have voids extending between each opening 604 to facilitation situation of the rehabilitation devices 100 in the positioning structure 602.

In some embodiments, movement of the rehabilitation devices 100 may be compound. For example, by bringing ends of the rehabilitation devices 100 together on one side of the positioning structure 602, ends of the rehabilitation devices 100 on the other side of the positioning structure 602 are moved away from one another. When ends of the rehabilitation devices 100 are moved upward on one side of the positioning structure 602, ends of the rehabilitation devices 100 on the other side of the positioning structure 602 are moved downward. When fingers coupled to ends of the rehabilitation devices 100 on one side of the positioning structure 602 are moved in flexure, other fingers at ends of the rehabilitation devices 100 on the other side of the positioning structure 602 are moved in extension. When fingers coupled to ends of the rehabilitation devices 100 on one side of the positioning structure 602 are moved in one rotational direction, other fingers at ends of the rehabilitation devices 100 on the other side of the positioning structure 602 are moved in a counter-rotational direction. Other motions and opposite reciprocal motions may also be achieved.

In some embodiments, the rehabilitation system 600 may include a base 606. The base 606 may be coupled to the positioning structure 602 to provide stabilizing or orienting support to the positioning structure 602. For example, the base 606 may be a table or be set on, or secured to a surface 608 such as a table, floor, wall, or other surface. The base 606 may also be coupled to a user's chest via straps or other structure. In some embodiments, the positioning structure 602 may be coupled to the user, a mounting surface, the base 606, or so forth via straps, struts, links, or so forth.

In some embodiments, the rehabilitation system 600 may include sensors, cameras, and so forth and provide information to, and receive information from, a computer executed program to record, monitor, control, guide, or otherwise interact with one or more features, operations, or components of the rehabilitation system 600.

Figure 7:
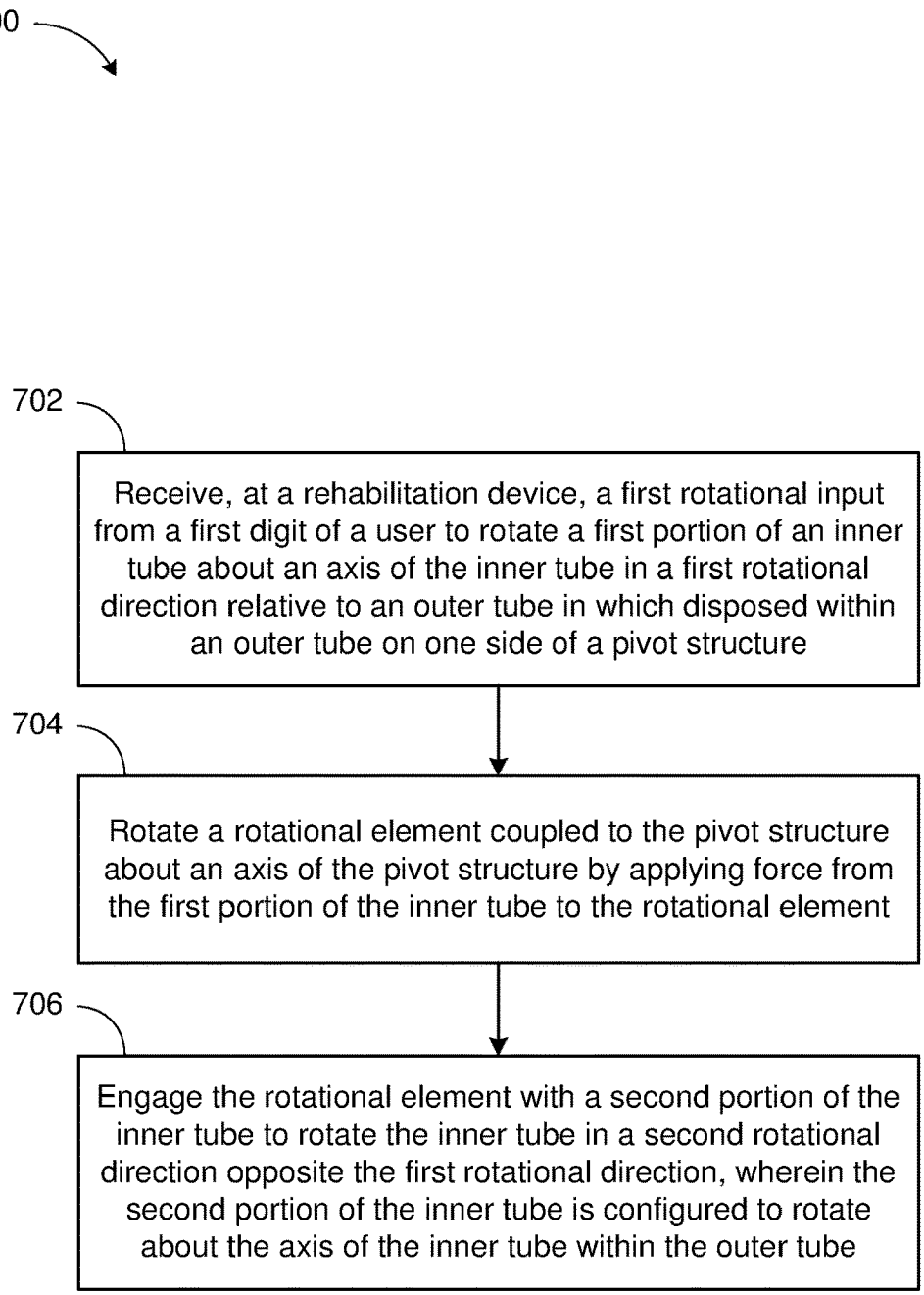
FIG. 7 illustrates a flowchart of a method, according to an embodiment.

FIG. 7 illustrates a flowchart of a method, according to an embodiment. Some embodiments provide multiple degrees of freedom and movement patterns that stimulate neural plasticity for improvement of limb dexterity.

In some embodiments, the method 700 may include receiving, at a rehabilitation device, a first rotational input from a first digit of a user to rotate a first portion of an inner tube about an axis of the inner tube in a first rotational direction relative to an outer tube in which disposed within an outer tube on one side of a pivot structure, at block 702. For example, the rehabilitation device 100 may receive a force from a digit of a user which rotates the first portion 104A of the inner tube 104.

The method 700 may include rotating a rotational element coupled to the pivot structure about an axis of the pivot structure by applying force from the first portion of the inner tube to the rotational element, at block 704. For example, the rotational element 112 may be a long flexible structure that rotates about the pivot structure 110 or the rotational element 112 may include a pivot gear 406 which rotates about an axis of the pivot structure 110.

The method 700 may include engaging the rotational element with a second portion of the inner tube to rotate the inner tube in a second rotational direction opposite the first rotational direction, wherein the second portion of the inner tube is configured to rotate about the axis of the inner tube within the outer tube, at block 706. For example, the rotational element might lever a post of the first or second portion of the inner tube to move one of the first or second portion in response to the input force from the digit of the user at the other of the first or second portion.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A rehabilitation device comprising:

an outer tube having a hollow cylindrical geometry;

a pivot structure configured to:

have a diameter less than a diameter of the outer tube; and perpendicularly intersect through the outer tube at a midpoint of the outer tube;

an inner tube configured to:

parallel the outer tube and disposed coaxially within the outer tube; and have a length greater than a length of the outer tube;

wherein the inner tube comprises:

a first portion disposed within the outer tube to be on one side of the outer tube relative to the pivot structure; and a second portion disposed within the outer tube to be on another side of the outer tube opposite the first portion relative to the pivot structure, wherein the first portion and the second portion are configured to rotate within the outer tube;

a rotational element coupled to the pivot structure and configured to:

rotate about an axis of the pivot structure; and interface with the first portion of the inner tube and the second portion of the inner tube to rotate one of the first portion or the second portion of the inner tube in a first rotational direction to counter-rotate the other of the first portion or the second portion of the inner tube in a second rotational direction opposite the first rotational direction; and a central rod disposed within the inner tube to be coaxial to the inner tube and the outer tube and configured to translate axially within the inner tube, wherein the central rod has a length greater than the length of the inner tube.

2. The rehabilitation device of claim 1, wherein the rotational element is configured to:

have an elongated geometry oriented perpendicular to the pivot structure; and rotate about the pivot structure in response to rotation of at least one of the first portion or the second portion of the inner tube.

3. The rehabilitation device of claim 2, further comprising:

a first post extending perpendicularly outward from the first portion of the inner tube at a location on the first portion of the inner tube proximate the pivot structure, wherein the first post extends through a first slot formed in the outer tube to couple the first post to the rotational element; and a second post extending perpendicularly outward from the second portion of the inner tube at a location on the second portion of the inner tube proximate the pivot structure, wherein the second post extends through a second slot formed in the outer tube to couple the second post to the rotational element.

4. The rehabilitation device of claim 1, wherein the rotational element comprises a pivot gear disposed on an end of the pivot structure to be within the outer tube and rotate within the outer tube.

5. The rehabilitation device of claim 4, further comprising:

a first gear:

coupled to an end of the first portion of the inner tube proximate the pivot structure; and positioned to interface with the pivot gear; and a second gear:

coupled to an end of the second portion of the inner tube proximate the pivot structure; and positioned to interface with the pivot gear, wherein rotation of one of the first gear or the second gear rotates the pivot gear to counter-rotate the other of the first gear or the second gear.

6. The rehabilitation device of claim 1, further comprising a coupler:

connected to the central rod; and configured to interface with a digit of a user, wherein movement of the digit of the user angularly translates the rehabilitation device, rotates the inner tube about an axis of the inner tube, or axially translates the central rod.

7. The rehabilitation device of claim 1, further comprising an alignment structure disposed within the rehabilitation device to align at least one of the outer tube, the inner tube, or the central rod with another of the at least one of the outer tube, the inner tube, or the central rod.

8. A rehabilitation system comprising:

a positioning structure comprising an opening passing through a thickness of the positioning structure;

a rehabilitation device:

disposed in the opening of the positioning structure; and configured to move a limb of a user opposite reciprocally;

the rehabilitation device comprising:

an outer tube having a hollow cylindrical geometry;

a pivot structure intersecting through the outer tube and non-parallel to the outer tube;

an inner tube disposed coaxially within the outer tube and having a length greater than a length of the outer tube, wherein the inner tube comprises:

a first portion disposed within the outer tube to be on one side the pivot structure within the outer tube; and a second portion disposed on another side of the pivot structure opposite the first portion, wherein the first portion and the second portion are configured to rotate within the outer tube;

a rotational element coupled to the pivot structure and configured to:

rotate about an axis of the pivot structure; and rotate one of the first portion or the second portion of the inner tube in response to rotation of the other of the first portion or the second portion of the inner tube; and a central rod:

disposed coaxially within the inner tube;

configured to translate axially within the inner tube; and having a length greater than the length of the inner tube.

9. The rehabilitation system of claim 8, further comprising a base coupled to the positioning structure to facilitate stabilization of the rehabilitation system relative to a surface.

10. The rehabilitation system of claim 8, further comprising a strap to secure the rehabilitation system relative to a surface.

11. The rehabilitation system of claim 8, wherein the positioning structure is at least partially hollow to accommodate a geometry of the rehabilitation device within the positioning structure between corresponding ones of the openings in the positioning structure.

12. The rehabilitation system of claim 8, wherein the positioning structure forms a lever point for the rehabilitation device to cause angular rotation of the rehabilitation device about an intersection of the positioning structure and the rehabilitation device.

13. The rehabilitation system of claim 8, wherein a geometry of the opening is shaped to control a movement range of the rehabilitation device.

14. A method comprising:

receiving, at a rehabilitation device, a first rotational input from a first digit of a user to rotate a first portion of an inner tube about an axis of the inner tube in a first rotational direction relative to an outer tube in which disposed within an outer tube on one side of a pivot structure;

rotating a rotational element coupled to the pivot structure about an axis of the pivot structure by applying force from the first portion of the inner tube to the rotational element; and engaging the rotational element with a second portion of the inner tube to rotate the inner tube in a second rotational direction opposite the first rotational direction, wherein the second portion of the inner tube is configured to rotate about the axis of the inner tube within the outer tube.

15. The method of claim 14, further comprising translating a central rod along an axis of the central rod, wherein the axis of the central rod is coaxial with an axis of the outer tube.

16. The method of claim 15, further comprising generating a flexure-extension movement in one of the first digit or second digit of the user in response to a force applied by the other of the first digit or the second digit of the user to translate the central rod along the axis of the central rod.

17. The method of claim 14, wherein receiving the first rotational input from the first digit comprises receiving a rotational movement of a coupler attached to the digit of the user.

18. The method of claim 14, further comprising rotating a second digit of the of the user by applying a force to the second digit of the user in response to rotation of the second portion of the inner tube in the second rotational direction.

19. The method of claim 14, wherein rotating the rotational element further comprises interfacing a first gear coupled to the first portion of the inner tube the rotational element, wherein:

the rotational element comprises a pivot gear configured to interface with the first gear and with a second gear coupled to the second portion of the inner tube; and the interface of the first gear, the pivot gear, and the second gear rotates the second portion of the inner tube in the second rotational direction opposite the first rotational direction of the first portion of the inner tube.

20. The method of claim 14, further comprising angularly rotating the rehabilitation device to reorient an axis of the outer tube about an intersection of the rehabilitation device with a positioning structure configured to lever the rehabilitation device at the intersection.

* * * * *